United States Patent [19]

Scheurer

[11] Patent Number: 4,981,233

[45] Date of Patent: Jan. 1, 1991

[54] POSITIVE PRESSURE CLOSURE LID FOR BEVERAGE CAN

[76] Inventor: Robert S. Scheurer, 1627 Midwestern Pkwy., Wichita Falls, Tex. 76302

[21] Appl. No.: 561,372

[22] Filed: Jul. 31, 1990

Related U.S. Application Data

[63] Continuation of Ser. No. 393,571, Aug. 14, 1989, abandoned.

[51] Int. Cl.[5] ..... B65D 51/24

[52] U.S. Cl. ..... 220/212; 220/306; 215/228

[58] Field of Search ..... 215/228; 220/212, 306, 220/355, 90.2, 90.4, 90.6

[56] References Cited

U.S. PATENT DOCUMENTS

| | | | |
|---|---|---|---|
| 3,557,986 | 1/1971 | Poole, Jr. | 215/228 |
| 3,602,387 | 8/1971 | Patnaude | 215/228 X |
| 3,640,422 | 2/1972 | Harschel | 220/233 |
| 3,672,114 | 6/1972 | Sacks | 215/228 X |
| 3,853,222 | 12/1974 | Helms | 206/315 |
| 4,033,091 | 7/1977 | Saponara | 215/228 X |
| 4,446,984 | 5/1984 | Roth et al. | 220/307 X |
| 4,524,877 | 6/1985 | Saxby et al. | 215/228 |
| 4,640,426 | 2/1987 | Wasley | 215/228 |
| 4,640,435 | 2/1987 | Dutt | 220/307 |
| 4,693,410 | 9/1987 | Selz | 220/90.4 X |
| 4,723,670 | 2/1988 | Robinson et al. | 215/228 |
| 4,763,802 | 8/1988 | Johnston | 215/228 |
| 4,763,803 | 8/1988 | Schneider | 215/260 |
| 4,768,665 | 9/1988 | Ballas | 215/228 |
| 4,773,458 | 9/1988 | Touzani | 220/1 R |
| 4,823,968 | 4/1989 | Handzlik | 215/228 |

*Primary Examiner*—Stephen Marcus
*Assistant Examiner*—Nova Stucker
*Attorney, Agent, or Firm*—Dennis T. Griggs

[57] ABSTRACT

A positive pressure closure lid has a single stroke bellows pump for pressurizing the internal open space of an aluminum beverage can. The pressure cap has a bifurcated seal which curls around and tightly engages opposite sides of the rolled top rim of the beverage can. As the bellows pump is pressed downwardly, a bellows cap is held in the collapsed position by a pair of resilient snap retainers. The slight pressurization provided by the single stroke bellows pump retards the release of carbonated gases from the beverage, thus preserving the flavor of the beverage after the pressurized can has been opened. Increased internal pressure provided by the bellows pump reinforces the sealing engagement of an internal annular flange portion of the bifurcated seal.

6 Claims, 2 Drawing Sheets

POSITIVE PRESSURE CLOSURE LID FOR BEVERAGE CAN

This is a continuation of co-pending application Ser. No. 07/393,591 filed on 8/14/89, now abandoned.

FIELD OF THE INVENTION

This invention relates generally to closures for beverage containers, and in particular to a positive pressure closure lid having a bellows pump for pressuring a metal beverage can with ambient air.

BACKGROUND OF THE INVENTION

Carbonated cola beverages are sold in 12 ounce metal containers which are pressurized and sealed by an origianl factory closure lid. A common beverage container in widespread use is the seamless, extruded aluminum can which includes a sealing lid joined to a cylindrical sidewall along a rolled, annular rim. The closure lid is scored along a line which defines the outline of a dispensing opening. A metal opening tab is attached to the lid for rupturing the lid along the score line. The scored segment is displaced into the interior of the can upon opening and cannot be resealed.

Carbonated beverages contain dissolved carbon dioxide gas which will escape into the atmosphere unless the container is pressurized and sealed. The flavor of such carbonated beverages turns flat in the absence of the dissolved carbon dioxide gas. The loss of dissolved carbonation can be reduced somewhat by sealing the beverage container after use.

The extruded aluminum can having a closure lid which is punctured for dispensing purposes is disposable and not intended to be resealed. Unless the beverage is consumed within a short time after opening, the carbonation will be released, with the result that the flavor of the remaining beverage is impaired. Accordingly, the quality of the remaining beverage will gradually deteriorate with the result that the remaining beverage will become unpalatable, and will be discarded.

There are occasions when it is not convenient or desirable to consume the entire contents while the beverage is fresh. One reason for this is that the 12 ounce volume of the carbonated beverage may be substantially more than is wanted or needed. Children may open a beverage can and consume only a limited amount which satisfies their needs for the moment. Others, including adults, may find it convenient or desirable to use only a portion of the beverage contents, for example as a mixer. In such instances, the remaining portion of the carbnonated beverage will quickly become flat and unpalatable. For that reason, it is customary to discard any carbonated beverage which may be left over and not consumed within an hour or so after the dcarbonated beverage container has been opened.

DESCRIPTION OF THE PRIOR ART

The practice of resealing the open volume within a beverage container to reduce the rate of carbonation loss is commonly accepted. Closure devices having a resilient sealing member for insertion into and engaging the neck of a dispensing opening have been used to good advantage in sealing the contents of glass and plastic bottle containers.

It has also been recognized and demonstrated that if the open space within the beverage container is repressurized with ambient air, the amount of dissolved carbon dioxide released from the beverage will be substantially reduced. Pumping devices have been proposed for pressurizing the open volume within a glass or plastic bottle container with ambient air. Such arrangements have been successful in combination with glass and plastic bottle containers of the type having a long neck passage in which the pump and closure can be inserted. However, conventional pumps suitable for use with such bottle containers are not adaptable for use with metal beverage cans.

OBJECTS OF THE INVENTION

It is, therefore, the principal object of the present invention to provide an improved closure cap/pump combination for sealing and pressurizing a carbonated beverage container of the metal cannister type.

Another object of the invention is to provide an improved pump and closure assembly which is externally mountable onto a metal beverage can.

Yet another object of the invention is to provide an improved closure cap assembly for use in combination with a metal beverage can having improved sealing means for preventing the escape of gases out of the internal open space of the container after it has been opened.

SUMMARY OF THE INVENTION

The foregoing objects are achieved according to the present invention by a pressure cap having a bifurcated sealing rim which curls around and tightly engages inner and outer sides of the rolled top rim of a beverage can. A single stroke bellows pump is attached to the closure lid for applying a positive pressure to the interior space of the open beverage can after it has been opened. As the bellows is pressed downwardly, the bellows cap is held in the collapsed position by a pair of resilient snap retainers. As the bellows collapses, air is forced into the interior open space of the beverage can, thereby increasing the internal pressure of the can to a level above atmospheric.

The pressure cap is sealed onto the beverage container by internal and external seal members. The pressure cap is sealed externally by an annular shoulder which engages the rolled outer rim of the can, and internally by an annular flange portion which engages the internal beveled shoulder of the rolled rim.

The pressurization provided by the single stroke bellows pump retards the release of the carbonated gases from the beverage, thus preserving the flavor of the beverage after the pressurized can has been opened. Moreover, the increased internal pressure reinforces the force of sealing engagement of the internal annualar flange portion against the internal beveled rim.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1:
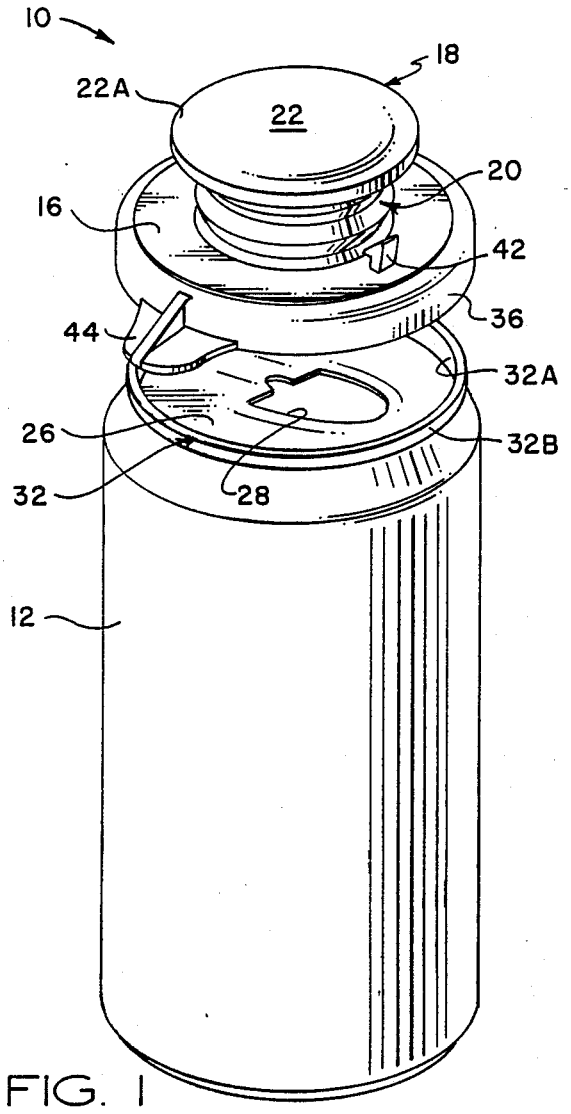
FIG. 1 is a perspective, exploded view of an aluminum beverage can and positive pressure closure cap of the present invention.

In the description which follows, like parts are marked throughout the specification and drawings with the same reference numerals, respectively. The drawings are not necessarily to scale and the proportions of certain parts have been exaggerated to better illustrate operation of the preferred embodiment.

Referring now to FIGS. 1–4, an improved positive pressure closure cap/pump assembly 10 is provided for sealing a beverage container 12 after it has been opened. The container 12 is preferably a seamless, extruded aluminum can. However, the closure cap/pump assembly 10 performs equally well with other container materials such as steel alloys and molded polymers. A volume of carbonated cola beverage 14 (FIG. 6) is enclosed within the beverage container 12. The closure cap/pump assembly 10 includes a closure lid 16 to which a bellows pump 18 is attached. The bellows pump 18 includes a flexible bellows 20 and an actuator cap 22. The flexible bellows 20 includes tubular, flexible and foldable sidewall segments 20A secured to the closure lid 16 in concentric relation with a pump discharge opening 24 formed in the lid 16.

The beverage container 12 includes a top closure lid 16 which is sealed onto the upper rim 12A of the cylindrical side-wall 12. A dispensing opening 28 is formed through the top closure lid 26 through which the carbonated cola beverage 14 may be served. The dispensing opening 28 may be formed by a punch, or with the aid of a ring tab (not illustrated) which ruptures a portion of the top closure lid about a score line which is preformed in the closure lid 26. After the opening 28 has been produced, the pressurized contents of the can 12 are exposed to atmospheric pressure, thereby permitting the escape of pressurized gases from the internal open space 30 through the dispensing opening 28.

Figure 6:
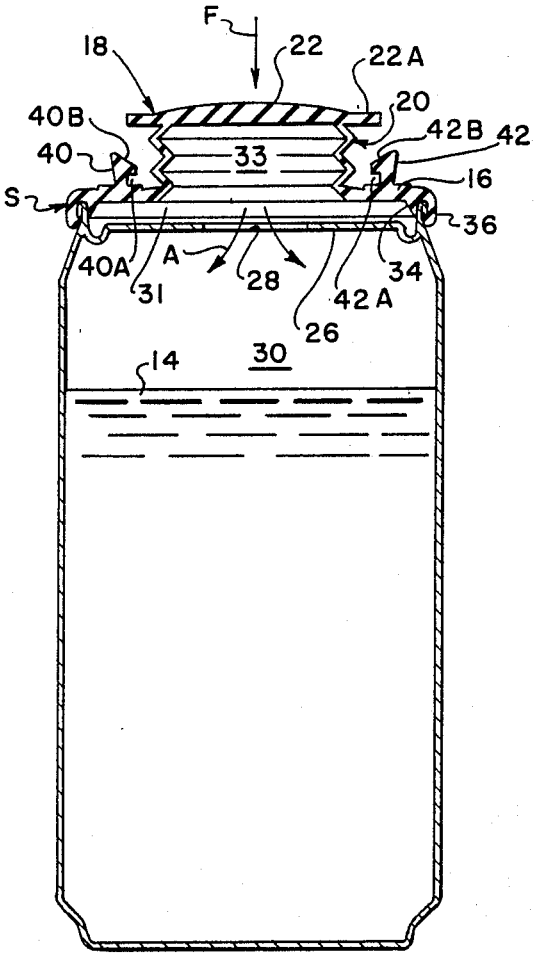
FIG. 6 is a longitudinal view in half section of a positive pressure closure cap assembled onto a beverage can.
Figure 7:
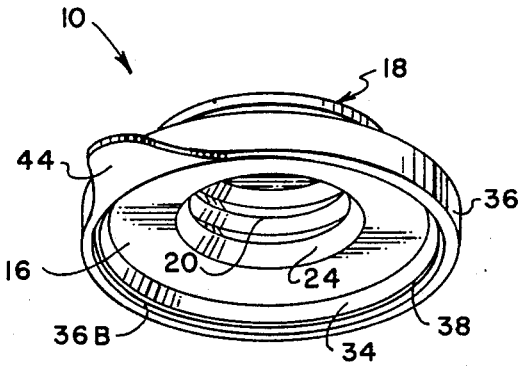
FIG. 7 is a perspective underside view of the positive pressure closure cap of the present invention; and, FIG. 8 is an enlarged view, partially broken away, which illustrates interlocking sealing engagement of the positive pressure closure cap onto a metal can beverage container.
Figure 8:
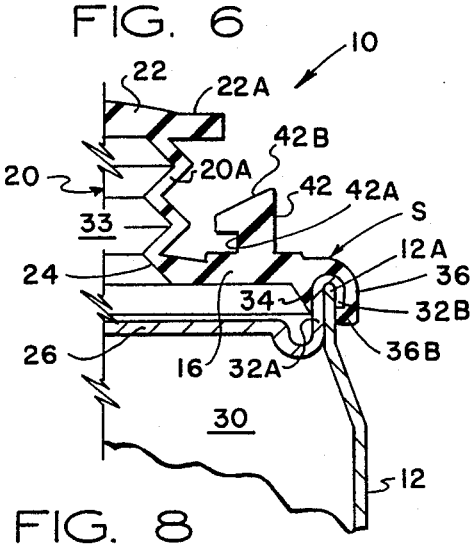

Referring now to FIGS. 1, 6 and 8, the top closure lid 26 is sealed onto the upper annular rim 12A of the clyindrical container sidewall 12 by a rolled flange 32. The rolled flange 32 includes an internal beveled shoulder 32A which engages the inside cylndrical surface of the sidewall 12, and an external flange 32B which is rolled over and about the upper cylindrical rim 12A. The roller flange 32 is pressure welded onto the upper annular rim 12A, thereby defining a strong mechanical and fluid seal.

According to an important feature of the preferred embodiment, the closure cap assembly 10 includes a bifurcated rim seal S which positively engages both internal and exernal side surfaces 32A, 32B of the rolled flange 32. As can best be seen in FIG. 8, the bifurcated rim seal S includes an internal sealing flange portion 34 and an external sealing flange portion 36. The external sealing flange 36 includes a sealing bead 36B which is received in detented engagement against the terminal face of the rolled flange 32B. The sealing bead 32B is received within an annular abutment recess defined adjacent the terminal face of the external rolled flange 32B and the external surface of the cylindrical container sidewall 12. The internal sealing flange 34 is held in annular surface engagement against the beveled internal shoulder portion 32A of the rolled flange 32.

According to the foregoing bifurcated rim seal structure S, the internal open space 30, and the bellows space 31 betweem the closure camp 16 and the closure lid 26, and the bellows chamber 33 are sealed by positive engagement of the internal sealing flange 34 against the beveled shoulder 32A. Sealing engagement is reinforced by pressurizing the internal open space 30 and bellows space 31. The internal pressure applies a sealing force against the internal sealing rim 34, thereby reinforcing its engagement. Moreover, sealing engagement is further stabilized by the gripping force of engagement exerted by the bifurcated sealing flange portions 34, 36 against opposite sides of the rolled flange 32.

The closure cap/pump assembly 10 is mounted onto the aluminum beverage can 12 by inserting the roller flange 32 into an annular pocked 38 defined between the internal sealing flange 34 and external sealing flange 36. It will be appreciated that the detented, interlocked engagement provided by the internal sealing flange 34, the external sealing flange 36 and the sealing bead 38 onto the rolled flange 32 securely fastens the closure cap/pump assembly onto the alumium beverage can 12 and prevents leakage of the beverage 14 should the can be tipped over. Moreover, the interlocking sealing engagement provides a secure fluid seal which prevents the escape of pressurized gases from the open space 30.

Figure 2:
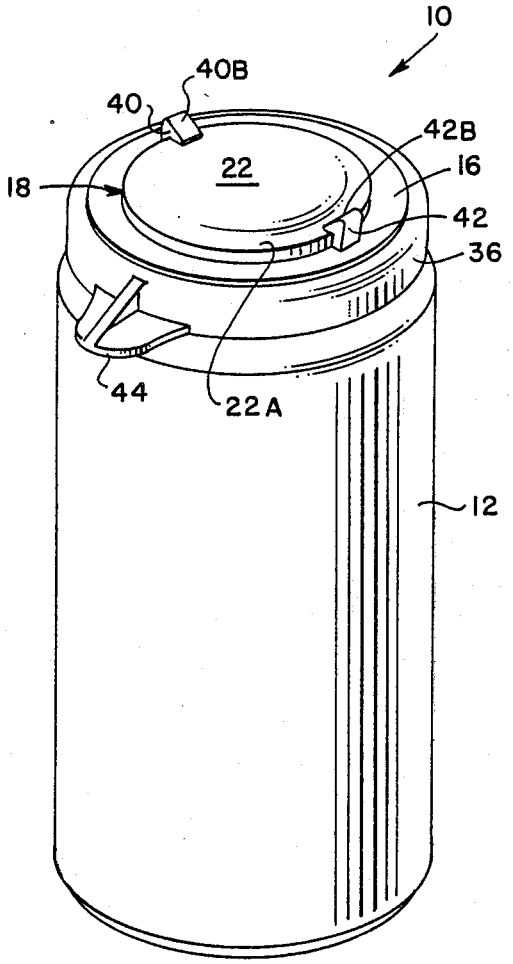
FIG. 2 is a perspective view of the positive pressure closure cap of the invention shown assembled onto an aluminum beverage can.
Figure 4:
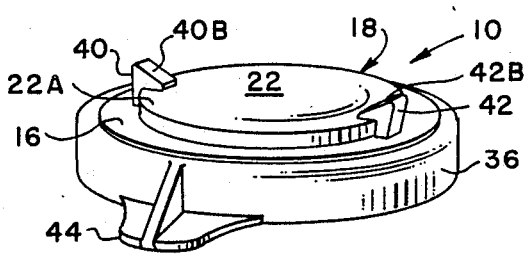
FIG. 4 is a perspective view of the positive pressure closure cap with bellows collapsed and latched.
Figure 5:
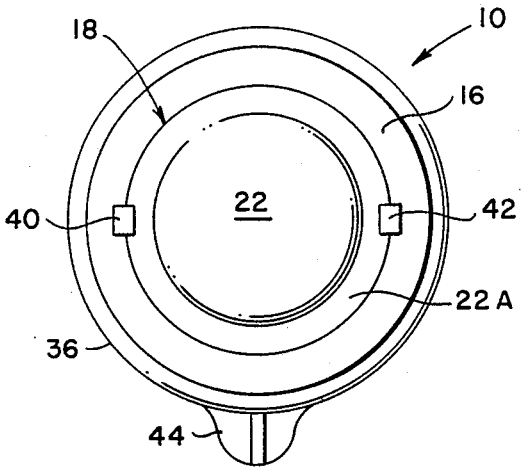
FIG. 5 is a top plan view of the positive pressure closure cap of FIG. 4.

According to another important feature of the invention, the bellows pump 184 is secured in the positive pressure, collapsed position as shown in FIGS. 2 and 4 by a pair of resilient retainers 40, 42. In this arrangment, the bellows actuator cap 22 is provided with an annular locking flange 22A which projects radially outwardly with respect to the bellows 20. The resilient retainers 40, 42 have slots 40A, 42A, respectively, for receiving the annular cap flange portion 22A as shown in FIGS. 2 and 4.

The resilient retainers 40, 42 also have sloping faces 40B, 42B, respectively. The sloping faces 40B, 42B are engaged by the annular cap flange portion 22A as the actuator cap 22 is pushed downwardly to its collapsed position. The resilient retainers 40, 42 deflect radially outwardly in response to the force of downward engagement, thereby admitting the annular cap flange portion 22A into the slots 40A, 42A. The actuator cap 22 becomes locked in place by the interlocking engagement of the resilient retainers 40, 42 against the actuator cap flange portion 22A. By this arrangement, a positive pressure exceeding atmospheric is produced within the open space 30 of the beverage container 12, and the bellows 20 is retained in the collapsed position indefinitely.

Figure 3:
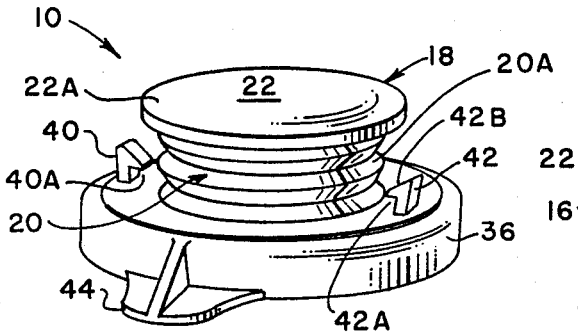
FIG. 3 is a perspective view of the positive pressure closure cap with bellows extended.

Because the closure cap/pump assembly 10 of the present embodiment does not include a check valve, it is only capable of a single stroke pumping action. After the single stroke has been accomplished, the bellows 20 is collapsed and the actuator cap 22 is locked in place automatically by the resilient retainers 40, 42. The bellows 20 can be released and returned to the extended position as shown in FIG. 3 merely by deflecting the resilient retainers 40, 42 outwardly to permit disengagement of the actuator cap flange 22A out of the slots 40A, 42A.

The closure cap/pump assembly 10 is preferably constructed of a durable, resilient polymer material and is reusable. The closure cap/pump assembly may be quickly disengaged from the aluminum beverage can 12 by lifting the annular sealing bead 36B radially away from the sidewall 12 and pulling the rolled flange 32 out of the sealing pocked 38. A radially projecting release tab 44 is integrally formed with the external sealing rim portion 36 for that purpose.

Referring again to FIGS. 1 and 2, upon initial assembly, the closure cap assembly 10 is installed onto the beverage can 12 by inserting the cylindrical portion of the rolled rim 32 into the annular pocket 38 with the bifurcated rim seal S. After the closure cap assembly 10 has been secured as shown in FIG. 6, the bellows 20 is pressed downwardly and collapsed by manually exerting a single stroke pumping force F against the actuator cap 22. Air A trapped within the bellows chamber 33 is forced through the dispenser passage 28 into the open space 30 of the beverage container 12 as the bellows is compressed.

As the bellows actuator cap 22 moves downwardly, the annular locking flange portion 22A engages the sloping surfaces 40B, 42B of the retainers, thereby deflecting them radially outwardly. The annular locking flange portion 22A snaps into detented engagement within the slots 40A, 42A as the actuator cap is forced into engagement against the beverage container lid 26, as shown in FIG. 2. In the collapsed position, the tubular bellows sidewall 20A is compressed axially and displaced downwardly against the top closure lid 26, thereby assisting the actuator cap 22 in displacement of air A through the discharge opening 24 and through the dispenser passage 28 into the open space 30.

The actutator cap 22 is retained in the collapsed position indefinitely by the retainers 40, 42. The one stroke bellows pump provides positive presssurization of the internal open space 30, thereby retarding the loss of dissolved carbon dioxide from the beverage 14. Moreover, the rim seal S is reinforced by the internal pressure of the open air space which increases the sealing pressure of the internal sealing flange portion 34 against the beveled cylindrical shoulder 32A.

It will be appreciated that the closure cap/pump assembly can be quickly installed onto the top of an aluminum beverage can when it is desired to seal the remaining beverage contents to prevent loss of the beverage should the can be turned over, and to reduce the rate of loss of dissolved carbon dioxide gas from the beverage, thereby extending the storage time for the beverage after it has been opened.

While a preferred embodiment of the invention has been set forth for purposes of disclosure, modification to the disclosed embodiment as well as other embodiments thereof may occur to those skilled in the art. Moreover, the combination closure cap/pump assembly may be used equally well to seal and pressurize other cylindrical containers, for example non-metal containers such as tennis ball containers and plastic food containers. Accordingly, the appended claims are intended to cover all embodiments of the invention and modifications to the disclosed embodiment which do not depart from the spirit and scope of the invention.

What is claimed is:

1. A positive pressure closure lid for releasably sealing a container, said closure lid including a pump coupled to said closure lid, said pump having an actuator cap adapted for movement between extended and collapsed positions; and a deflectable retainer member externally mounted on said closure lid for retaining the cap in the collapsed position.

2. A positive pressure closure lid as defined in claim 1, wherein said pump is a bellows pump having a foldable sidewall which is movable between extended and collapsed positions.

3. A positive pressure closure lid as defined in claim 1, wherein said closure lid has a discharge opening and said pump being a bellows pump having a tubular, flexible sidewall connected in fluid communication with said discharge opening, said bellows sidewall being foldable and displaceable against the closure lid in response to movement of the actuator cap to the collapsed position.

4. A positive pressure closure lid as defined in claim 1, wherein said retainer member includes a ramp surface which is inclined with respect to the direction of movement of the actuator cap between the extended and collapsed positions, said retainer member inlcuding a slot for receiving the external rim of the actuator cap when the cap is moved to the collapsed position.

5. A positive pressure closure lid as defined in claim 1, wherein said closure lid includes a bifurcated seal, said bifurcated seal having an annular flange portion for positively engaging the internal surface of a rolled container rim and having an external annular flange portion for positively engaging an external annular surface of the container rim.

6. A positive pressure closure lid for releasably sealing a container of the type having a rolled rim, wherein said positive pressure closure lid includes a bifurcated seal of unitary construction, said bifurcated seal having an internal annular flange portion for positively engaging an internal surface of the rolled rim and an external annular flange portion for positively engaging an external annular surface of the rolled rim; and, said closure lid including a discharge opening and a pump coupled in fluid communication with the discharge opening, said pump having an actuator cap adapted for movement between extended and collapsed positions, and a plurality of retainer members attached to the lid for retaining the actuator cap in the collapsed position.

* * * * *

UNITED STATES PATENT AND TRADEMARK OFFICE

CERTIFICATE OF CORRECTION

PATENT NO. : 4,981,233

DATED : 01/01/91

INVENTOR(S) : Robert S. Scheurer

It is certified that error appears in the above-identified patent and that said Letters Patent is hereby corrected as shown below:

Column 1, line 10, "pressuring" should be -- pressurizing --.

Column 1, lines 15-16, "origianl" should be -- original --.

Column 1, line 51, "carbnonated" should be -- carbonated --.

Column 1, lines 54-55, "dcarbonated" should be -- carbonated --.

Column 2, line 52, "annualar" should be -- annular --.

Column 3, line 41, "side-wall" should be -- sidewall --.

Column 3, lines 53-54, "clyindrical" should be -- cylindrical --.

Column 3, line 56, "cylndrical" should be -- cylindrical --.

Column 4, line 12, "betweem" should be -- between --.

Column 4, line 12, "camp" should be -- cap --.

Column 4, line 25, "pocked" should be -- pocket --.

UNITED STATES PATENT AND TRADEMARK OFFICE

CERTIFICATE OF CORRECTION

PATENT NO. : 4,981,233

DATED : 1/1/91

INVENTOR(S) : Robert S. Scheurer

It is certified that error appears in the above-identified patent and that said Letters Patent is hereby corrected as shown below:

Column 5, line 10, "pocked" should be -- pocket --.

Signed and Sealed this

Ninth Day of June, 1992

*Attest:*

DOUGLAS B. COMER

*Attesting Officer*

*Acting Commissioner of Patents and Trademarks*